US006655288B2

(12) United States Patent
Veil

(10) Patent No.: US 6,655,288 B2
(45) **Date of Patent: *Dec. 2, 2003**

(54) METHOD FOR SPOT COATING ON PRINTING SUBSTRATES IN LARGE SIZE PRINTING MACHINES

(75) Inventor: Jürgen Veil, Dresden (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/993,236

(22) Filed: Nov. 14, 2001

(65) Prior Publication Data

US 2002/0124744 A1 Sep. 12, 2002

(30) Foreign Application Priority Data

Nov. 16, 2000 (DE) ..... 100 57 641

(51) Int. Cl.[7] ..... B41F 7/02; B05D 1/28

(52) U.S. Cl. ..... 101/491; 101/424.1; 101/424.2; 101/217; 118/46; 427/372.2

(58) Field of Search ..... 101/217, 424.1, 101/242.2, 491, 487, 488; 178/46, 58, 262; 427/577, 372.2

(56) References Cited

U.S. PATENT DOCUMENTS 4,939,992 A * 7/1990 Bird ..... 101/183
5,651,316 A * 7/1997 DeMoore et al. ..... 101/450.1
6,299,685 B1 * 10/2001 Siler et al. ..... 118/58
6,443,058 B1 * 9/2002 Stadler et al. ..... 101/23

* cited by examiner

*Primary Examiner*—Leslie J. Evanisko
*Assistant Examiner*—Leo T. Hinze
(74) *Attorney, Agent, or Firm*—Goodwin Procter LLP

(57) ABSTRACT

The present invention relates to a method and apparatus for spot coating on printing substrates in large size printing machines producing printed images by application of an ink layer on the printing substrates. The invention provides a method and apparatus for spot coating of printing substrates also applicable in large size printing presses. The present invention uses a universally applicable offset plate to coat substantially the entire area of a printed image, wherein the coating reacts with ink layers of at least two ink systems thereby changing the printed image so that areas of varying gloss degrees are created. The present invention uses a conventional printing press comprising at least two printing units for printing at least two ink systems, an optional dryer allocated to the printing units, and a coating unit for application of the final coating layer succeeding the printing units.

11 Claims, 1 Drawing Sheet

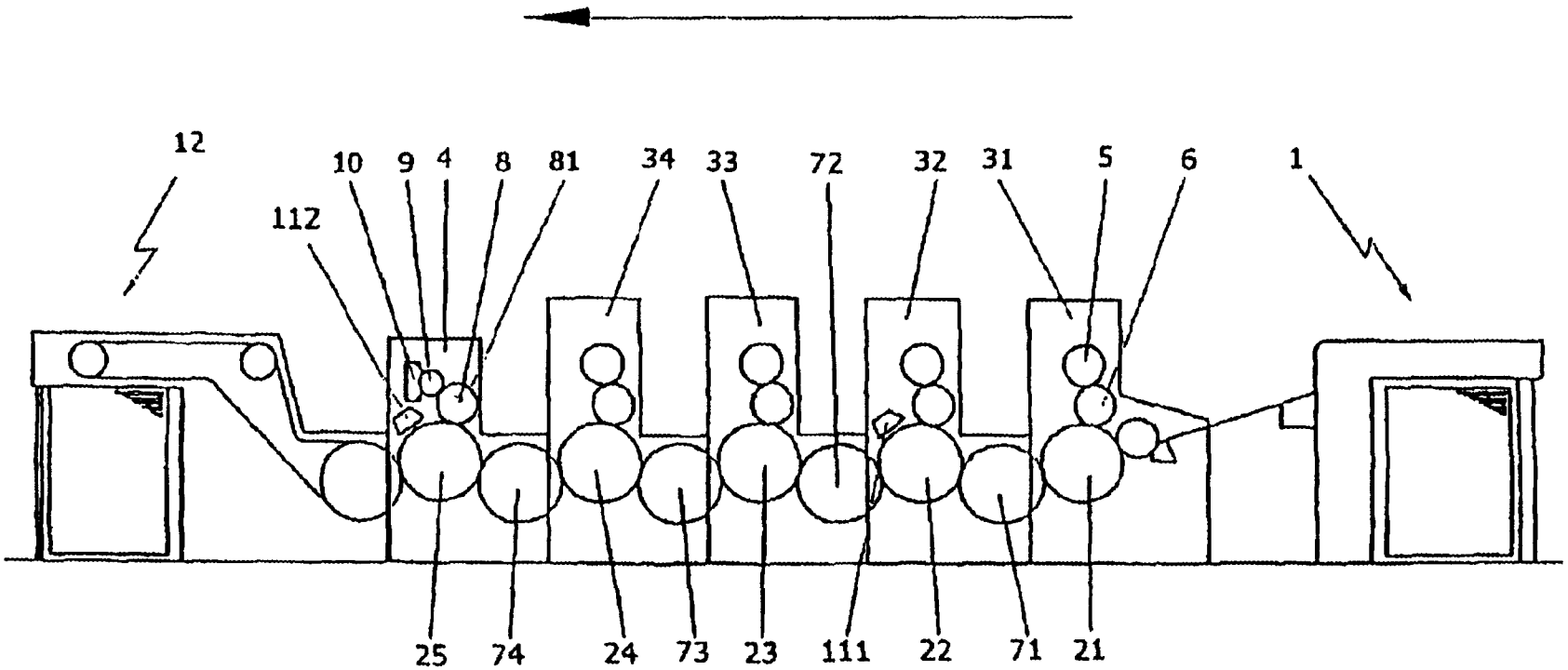
1
6
5
31
32
72
33
34
81
8
4
9
10
112
12
21
71
22
111
23
73
24
74
25

METHOD FOR SPOT COATING ON PRINTING SUBSTRATES IN LARGE SIZE PRINTING MACHINES

FIELD OF THE INVENTION

The present invention relates to a method and apparatus for spot coating on printing substrates in large size printing machines producing printed images by application of an ink layer on the printing substrates.

BACKGROUND OF THE INVENTION

Spot coating on surfaces of printing substrates is usually made by printing plates, which are especially made for this purpose. These printing plates have partial recesses. This solution is described in the $9^{th}$ edition of the book "Offsetdrucktechnik" (Offset printing) by Helmut Teschner on pages 11 to 43. This solution is not applicable for large size printing presses because the coating plates can not be manufactured in sufficient quality at such plate dimensions.

SUMMARY OF THE INVENTION

An object of the invention is to provide a method and apparatus for spot coating of printing substrates also applicable in large size printing presses.

"The present invention solves this and other problems by using a universally applicable offset plate to coat substantially the entire area of a printed image, wherein the coating reacts with ink layers of at least two ink systems thereby changing the printed image so that areas of varying gloss degrees are created. A printed offset plate may be used. The present invention uses a conventional printing press comprising at least two printing units for printing at least two ink systems, an optional dryer allocated to the printing units, and a coating unit for application of the final coating layer succeeding the printing units."

An advantage of the present invention is that varying degrees of gloss can be produced using only a single coating plate without partial recesses. The manufacturing cost for the coating plates decreased. The coating plate can now be used for several printing jobs so that the make ready time is reduced. Furthermore, only one coating unit or coating tower is required.

BRIEF DESCRIPTION OF THE DRAWING

The invention is described below in greater detail by an exemplary embodiment of the invention and by reference to the drawing, wherein:

The figure is a schematic drawing of a sheet fed offset press in unitized design.

DETAILED DESCRIPTION OF THE INVENTION

The sheet fed offset press in the figure has multiple printing units 31 to 34 arranged in unitized design. The embodiment shows four printing units 31 to 34 as an example. At least two printing units are used in the method according to the present invention.

A feeder 1 precedes the printing units 31 to 34. The structure and function of the feeder 1 are known and, thus, will not be described herein. Each of the printing units 31 to 34 has an impression cylinder 21 to 24, a plate cylinder 5 and a blanket cylinder 6. For illustrative purpose, the plate cylinder 5 and the blanket cylinder 6 are only denoted in the printing unit 31. The sheet travel direction is marked with an arrow. The figure also shows transfer drums 71 to 74 located between two impression cylinders 21 to 25. The transfer drums 71 to 74 can also be embodied as perfecting drums. The impression cylinders 21 to 24 and the transfer drums 71 to 74 may be sheet guiding cylinders of double diameter. Inking and dampening units allocated to each printing unit 31 to 34 are not shown in the figure.

The shown printing units 31 and 32 print with an ink system including ink constituents that dry under radiation, such as ultraviolet radiation. The printing units 33 and 34 print with typical offset ink.

In the exemplary embodiment, a dryer 111 is allocated to the printing unit 32. The dryer 111 dries the ink system, which is in this case an ultraviolet (UV) dryer.

A coating tower 4 follows the printing units 31 to 34 in the direction of the sheet travel. It has a coating form cylinder 8 allocated to the impression cylinder 25. The coating form cylinder 8 carries a coating plate 81. The coating tower 8 coats the printed image with a coating layer, which also dries under radiation.

A screened roller 9 is allocated to the coating form cylinder 8 and the coating plate 81. The screened roller 9 is equipped with a chamber doctor blade 10 to supply the coating. A dryer 112 is allocated to the coating tower 4.

The coating tower 4 is followed by a delivery unit 12. The structure and function of the delivery unit 12 are known and, thus, will not be described herein.

The above-described apparatus can operate according to the following method:

The printing sheet is supplied by the feeder 1 and forwarded by an unshown means for sheet travel. The ink of an ink system is applied in the printing units 31 to 32 through the blanket cylinder 6. The ink system includes proportional ink hardening under radiation, and in an exemplary embodiment, under ultraviolet radiation. These inks are denoted as hybrid ink.

Inks with similar processing characteristics are summarized herein as ink systems.

The ink layer is dried with the dryer 111 before the sheet is transferred to subsequent printing units 33 and 34. The printing sheet is here printed with an ink of an ink system comprising other inks, for instance, inks typically used for offset printing.

The coating is applied next over substantially the entire sheet by the coating plate 81 in the coating tower 4. The coating has the characteristics to react with ink systems differently, physically and/or chemically and to influence the degree of gloss in the ink layer variably. A colorless s coating that hardens like the hybrid ink hardens under ultraviolet light is us ed in the present embodiment. The coating layer is then dried in a dryer 112.

An additional feature for the above-mentioned effect is that the ink systems m ay differ from each other in their capacity of coating resorption. The degree of gloss is reciprocally proportional to the capacity for resorption of the ink system to the coating, whereby for ink layers of ink systems with lower capacity for resorption, more coating retains at their surfaces; for ink layers of ink systems with higher capacity for resorption, less coating retains a t their surfaces. The gloss-determining constituents of the coating are picked up by the ink layers.

The present invention is not limited to the above mentioned difference in the capacity for resorption of a coating layer. Rather, the present invention includes all ink systems that change their gloss degree or gloss effect in combination with the coating layer. Nevertheless, drying and/or hardening of the sheet or the printing substrate after printing with additional energy is not necessary. Other process treatments of the ink layers and/or coating layers by physical and/or chemical reactions are possible in order to obtain varying degrees of gloss on the final coating layer.

In another embodiment of the present invention, the process treatment can be eliminated totally or partially. The above mentioned effects are obtained by selection of suitable ink systems and a corresponding coating.

What is claimed is:

1. A method for spot coating on a printing substrate in a large size printing machine comprising:

producing a printed image by application of ink-layers on said printing substrate; said ink layers having surfaces;

coating said printed image using a universally applicable offset plate; wherein said coating reacts with said ink layers; wherein said ink layers are formed by at least two ink systems; and altering said printed image so that areas of varying degrees of gloss are created.

2. The method for spot coating on a printing substrate according to claim 1, wherein a printed offset plate is used.

3. The method for spot coating on a printing substrate according to claim 1, wherein said ink systems react physically and/or chemically with said coating layer.

4. The method for spot coating on a printing substrate according to claim 1, wherein said ink systems are treated by hardening and/or drying after application.

5. The method for spot coating on a printing substrate according to claim 1, wherein said ink systems vary in capacity for absorption of said coating.

6. The method for spot coating on a printing substrate according to claim 1, wherein said degrees of gloss are reciprocally proportional to said ink systems' capacity for absorption of said coating, whereby at ink layers of ink systems with lower capacity for absorption, more coating retains at said surfaces, and at ink layers of ink systems with higher capacity for absorption, less coating retains at said surfaces.

7. The method for spot coating on a printing substrate according to claim 1, wherein gloss determining constituents of said coating are absorbed by said ink layers.

8. The method for spot coating on a printing substrate according to claim 1, wherein the coating applied is colorless.

9. The method for spot coating on a printing substrate according to claim 1, wherein at least one of said ink systems comprises a hybrid ink containing proportional ink hardening under radiation and another ink system comprises a typical offset ink.

10. The method for spot coating on a printing substrate according to claim 9, wherein said hybrid ink and said coating are hardened by ultraviolet light.

11. The method for spot coating on a printing substrate according to claim 1, wherein said coating is hardened by radiation.

* * * * *